US006612036B2

(12) United States Patent
Frazier

(10) Patent No.: US 6,612,036 B2
(45) Date of Patent: Sep. 2, 2003

(54) EDGE PROFILE CUTTER

(76) Inventor: Michael J. Frazier, 920 Herron Dr., Waterloo, WI (US) 53594

( * ) Notice: Subject to any disclaimer, the term of this patent is extended or adjusted under 35 U.S.C. 154(b) by 57 days.

(21) Appl. No.: 09/995,036

(22) Filed: Nov. 26, 2001

(65) Prior Publication Data

US 2003/0097758 A1 May 29, 2003

(51) Int. Cl.[7] ..... B26B 1/00
(52) U.S. Cl. ..... 30/293; 30/294; 144/154.5
(58) Field of Search ..... 30/294, 308, 2, 30/293, 279.2, 121, 299, 287; 144/154.5

(56) References Cited

U.S. PATENT DOCUMENTS

| | | | | |
|---|---|---|---|---|
| 4,578,865 A | | 4/1986 | Keller | 30/304 |
| 4,777,724 A | * | 10/1988 | Sirchia | 30/287 |
| 5,048,188 A | | 9/1991 | Wolff | 30/288 |

* cited by examiner

*Primary Examiner*—Douglas D. Watts
(74) *Attorney, Agent, or Firm*—Donald J. Ersler

(57) ABSTRACT

The edge profile cutter includes a slidable base, a first cutting blade, and a second blade. The slidable base includes a base portion, an upright portion. The upright portion extends upward from a front of the base portion. A handle portion extends upward from the base portion at substantially a middle thereof. A first blade slot is formed in a bottom of the base to receive the first cutting blade. The first cutting blade may be adjusted within the first blade slot. Preferably, a first clamp slot is formed adjacent the first blade slot to receive a first clamp. The first clamp retains the first cutting blade. A second blade slot is formed in a front of the upright portion. The second cutting blade may be adjusted within the second blade slot. A second clamp preferably retains the second cutting blade. A lengthwise notch is formed in a front bottom edge of the base portion. The lengthwise notch may be sized to receive an end of a ceiling tile or the like. The first and second cutting blades extend into the lengthwise notch.

18 Claims, 4 Drawing Sheets

EDGE PROFILE CUTTER

BACKGROUND OF THE INVENTION

1. Field of the Invention

The present invention relates generally to manual cutting tools and more specifically to an edge profile cutter which may be used to cut a profile on the edge of a ceiling title or the like.

2. Discussion of the Prior Art

There appears to be only one tool in the prior art which may be used for cutting a profile on the edge of a ceiling title. U.S. Pat. No. 4,578,865 to Keller discloses a tile cutting device having parallel blades. However, U.S. Pat. No. 4,578,865 has at least one drawback, the forming of a profile requires that the user take two passes to cut out the waste portion. First, a vertical cut must be made, then a horizontal cut must be made to remove the waste portion.

Accordingly, there is a clearly felt need in the art for an edge profile cutter which only requires one pass to create a profiled edge on an item.

SUMMARY OF THE INVENTION

The present invention provides an edge profile cutter which is more efficient than that of the prior art. The edge profile cutter includes a slidable base, a first cutting blade, and a second blade. The slidable base includes a base portion and an upright portion. The upright portion extends upward from a front of the base portion. A handle portion extends upward from the base portion at substantially a middle thereof. A first blade slot is formed in a bottom of the base to receive the first cutting blade. The first cutting blade may be slid along a length of the first blade slot to extend or retract thereof. Preferably, a first clamp slot is formed adjacent the first blade slot for receiving a first clamp. The first clamp retains the first cutting blade. A second blade slot is formed in a front of the upright portion. The second cutting blade may be slid along a length of the second blade slot to extend or retract thereof. A second clamp preferably retains the second cutting blade.

A lengthwise notch is formed in a front bottom edge of the base portion. The lengthwise notch is sized to receive an end of a ceiling tile or the like. The first and second cutting blades extend into the lengthwise notch. To create the profiled edge, the edge profile cutter is placed at the corner of the ceiling tile. The ceiling tile is retained such that it does not move and the edge profile cutter is pulled along length of the ceiling tile end. The edge profile cutter is also maintained against the end of the ceiling tile while it is being pulled to produce a straight cut. The scrap material is removed from the end of the ceiling tile to produce a profiled edge.

Accordingly, it is an object of the present invention to provide an edge profile cutter which only requires one pass to create a profiled edge in a ceiling tile.

Finally, it is another object of the present invention to provide an edge profile cutter which allows the user to cut in a straight line.

These and additional objects, advantages, features and benefits of the present invention will become apparent from the following specification.

DETAILED DESCRIPTION OF THE PREFERRED EMBODIMENTS

Figure 1:
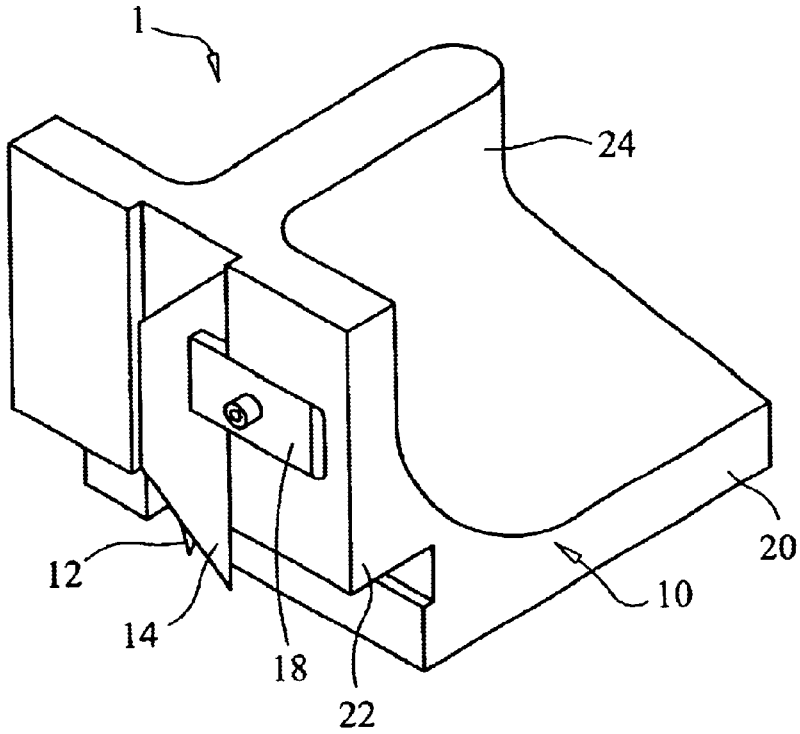
FIG. 1 is a perspective view of an edge profile cutter in accordance with the present invention.
Figure 1A:
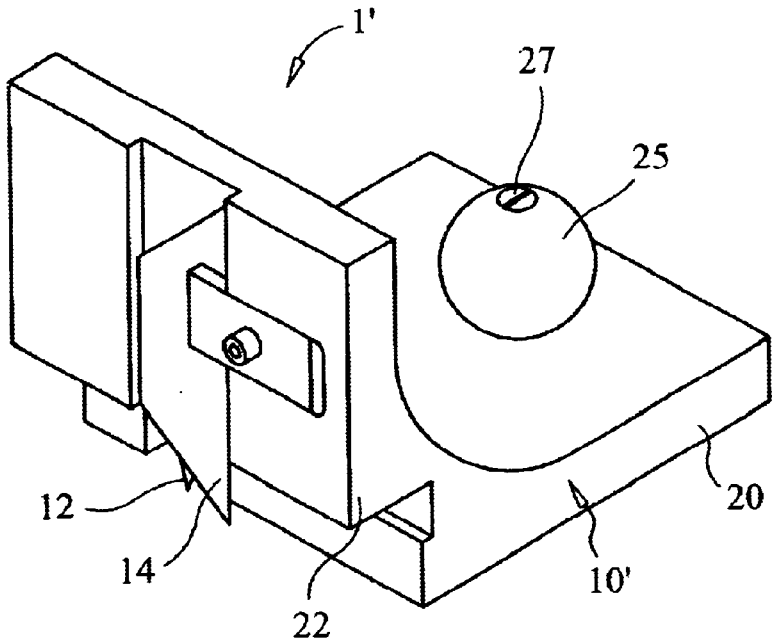
FIG. 1*a* is a perspective view of an edge profile cutter with a slidable base fabricated from an extrusion in accordance with the present invention.
Figure 2:
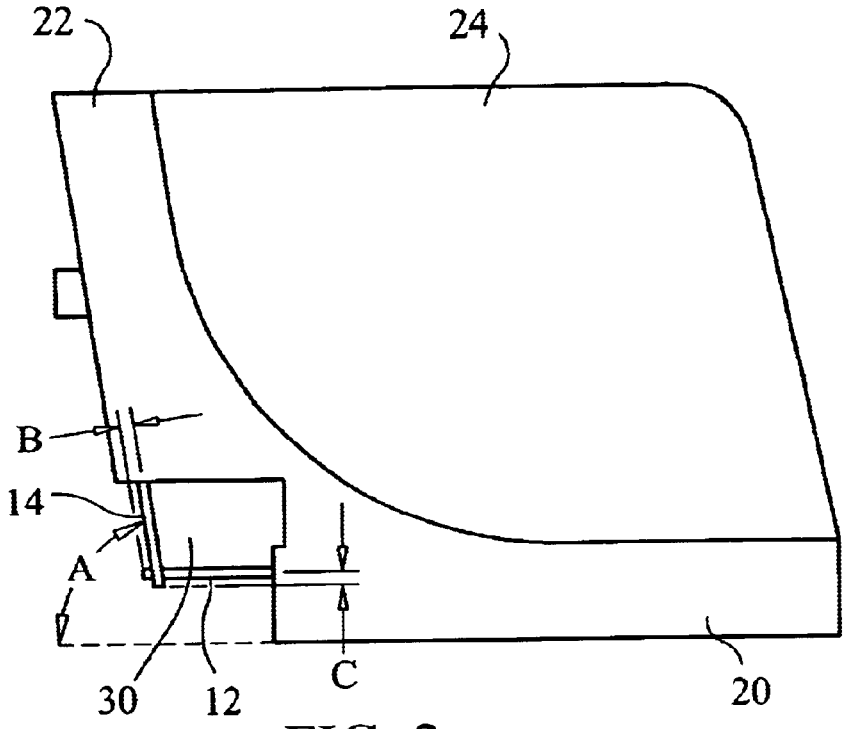
FIG. 2 is a side view of an edge profile cutter in accordance with the present invention.
Figure 3:
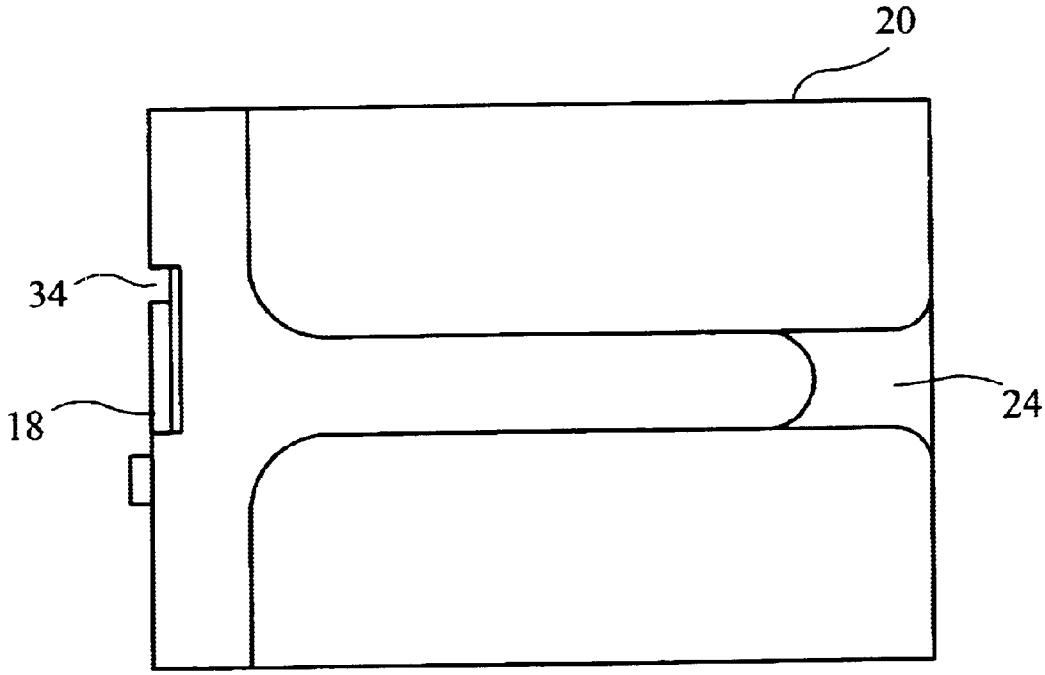
FIG. 3 is a top view of an edge profile cutter in accordance with the present invention.
Figure 4:
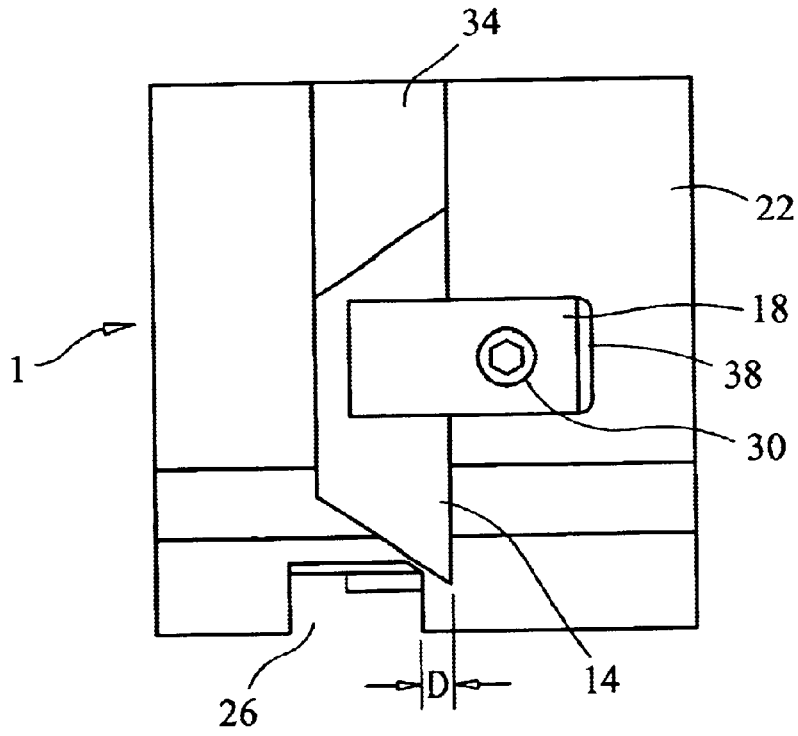
FIG. 4 is a front view of an edge profile cutter in accordance with the present invention.
Figure 5:
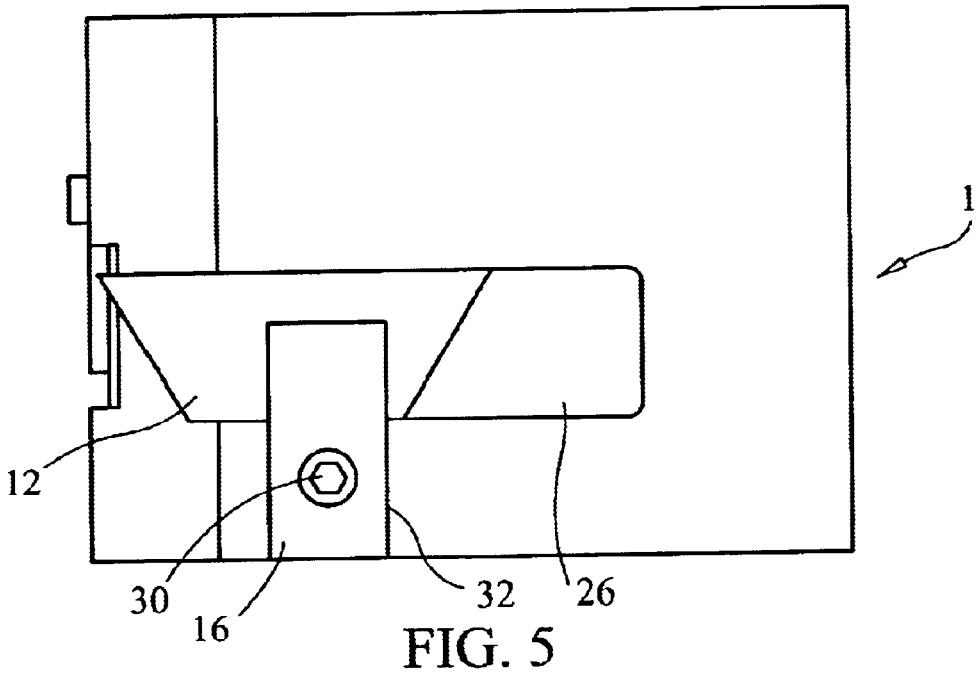
FIG. 5 is a bottom view of an edge profile cutter in accordance with the present invention.
Figure 6:
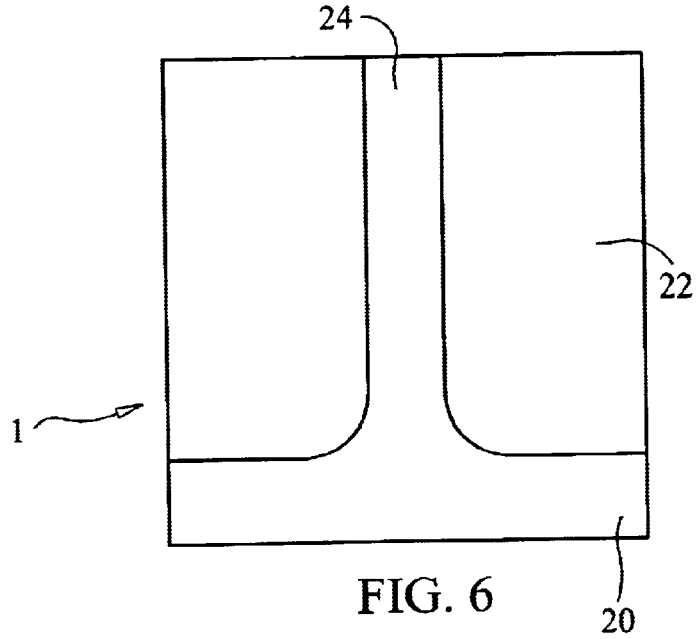
FIG. 6 is a rear view of an edge profile cutter in accordance with the present invention.

With reference now to the drawings, and particularly to FIG. 1, there is shown a perspective view of an edge profile cutter 1. With reference to FIGS. 2–6, the edge profile cutter 1 includes a slidable base 10, a first cutting blade 12, and a second blade 14. The first and second cutting blades are preferably box cutter type of blades, but other blades may also be used. The slidable base 10 includes a base portion 20 and an upright portion 22. The slidable base 10 may be created by a plastic molding process or a die casting process. The upright portion 22 extends upward from a front of the base portion 20. A handle portion 24 extends upward from the base portion 20 at substantially a middle thereof. With reference to figure 1*a* , an edge profile cutter 1' includes a slidable base 10' and a handle portion 25. The slidable base 10' is fabricated from an extrusion. The handle portion 25 is preferably attached to the base portion 20 with a fastener 27. Other methods of fabricating a slidable base may also be used besides plastic molding, die casting, or extrusion.

A first blade slot 26 is formed in a bottom of the base 10 to receive the first cutting blade 12. The first cutting blade 12 may be slid along a length of the first blade slot 26 to extend or retract thereof. Preferably, a first clamp 16 retains the first cutting blade 12, but other methods of retaining the first cutting blade 12 may also be used. The first clamp 16 is preferably tightened against the first cutting blade 12 with a threaded fastener 30. A first clamp slot 32 is formed adjacent the first blade slot 26 to receive the first clamp 16.

A second blade slot 34 is formed in a front of the upright portion 22. The second cutting blade 14 may be slid along a length of the second blade slot 34 to extend or retract thereof. Preferably, a second clamp 18 retains the second cutting blade 14, but other methods of retaining the second cutting blade 14 may also be used. The second clamp 18 is preferably tightened against the second cutting blade 14 with a threaded fastener 30. A second clamp slot 38 is preferably formed adjacent the second blade slot 34 to receive the second clamp 18.

The first cutting blade 12 is preferably adjusted to extend beyond the second cutting blade 14 by a dimension "B" and the second cutting blade 14 is preferably adjusted to extend beyond the first cutting blade 12 by a dimension "C". The purpose of extending the first and second cutting blades is to fully cutout the scrap material. The following dimension are given by way of example and not by way of limitation. Dimensions "B" and "C" preferably have a value of between 0.03–0.09 inches, but other values may also be used.

The first and second blade slots are preferably offset by a dimension D. The offset reduces the amount of effort required to cut away the scrap material. The following dimensions are given by way of example and not by way of limitation. Dimension "D" preferably has a value of between 0.03–0.19 inches, but other values may also be used. The first blade slot may lead the second blade slot or the second blade slot may lead the first blade slot.

A lengthwise notch 30 is formed in a front bottom edge of the base portion 10. The lengthwise notch 30 may be sized to receive an end of a ceiling tile or the like. The first cutting blade 12 and the second cutting blade 14 extend into the lengthwise notch 30. Angle "A" of the second cutting blade 14 relative to the horizontal may be varied during manufacturing to accommodate the profiled edge of the item cut. The following angle is give by way of example and not by way of limitation. Angle "A" is shown as being less than 90 degrees in FIGS. 2 and 7*b*. However, Angle "A" preferably has a range of between 45–135 degrees, but other angle values may also be used.

Figure 7A:
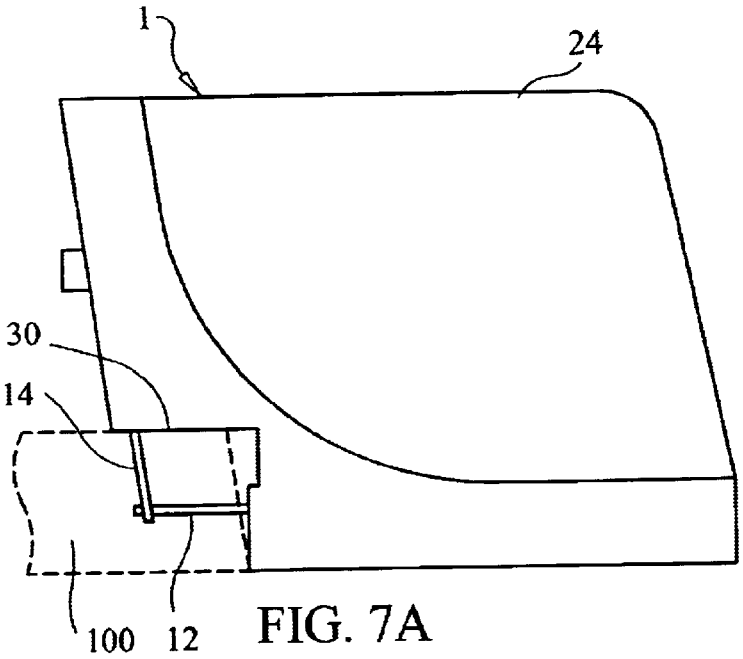
FIG. 7*a* is a side view of a ceiling tile before being cut with an edge profile cutter in accordance with the present invention.
Figure 7B:
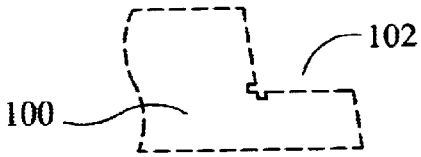
FIG. 7*b* is a side view of a ceiling tile after being cut with an edge profile cutter in accordance with the present invention.

With reference to FIGS. 7*a* and 7*b*, a profiled edge is created by slipping a corner of a ceiling tile 100 or the like into the lengthwise notch 30 and against the first and second cutting blades of the edge profile cutter 1. The ceiling tile 100 is retained such that it does not move and the edge profile cutter 1 is pulled along length of the ceiling tile end with a hand gripping the handle portion 24. The edge profile cutter 1 is also maintained against the end of the ceiling tile 100 while it is being pulled to produce a straight cut. The scrap material is removed from the end of the ceiling tile to produce a profiled edge 102. The first blade 12 makes a horizontal cut and the second blade 14 makes a substantially vertical cut.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An edge profile cutter comprising:

a slidable base having a base portion and an upright portion, a lengthwise notch being formed on a front edge of said base portion;

a first cutting blade being retained on a bottom of said slidable base, said first cutting blade protruding into said lengthwise notch;

a second cutting blade being retained on a front of said upright portion, said second cutting blade protruding into said lengthwise notch; and said first cutting blade being offset from said second cutting blade.

2. The edge profile cutter of claim 1 wherein:

said first cutting blade leading said second cutting blade.

3. The edge profile cutter of claim 1 wherein:

said second cutting blade leading said first cutting blade.

4. The edge profile cutter of claim 1, further comprising:

a handle portion extending upward from said base portion.

5. The edge profile cutter of claim 1, further comprising:

said first cutting blade being slidable within a first blade slot and said second cutting blade being slidable within a second blade slot.

6. The edge profile cutter of claim 1, further comprising:

a first clamp retaining said first cutting blade and a second clamp retaining said second cutting blade.

7. A method of cutting a profile on an edge of an item comprising the steps of:

(a) providing a base;

(b) attaching a first cutting blade to said base to make a horizontal cut;

(c) attaching a second cutting blade to said base to make a substantially vertical cut;

(d) positioning said base against an item such that said cutting blades will cut a profiled edge in an item;

(e) pulling said base along an edge of the item to cut the profiled edge in one pass; and (f) offsetting said first cutting blade from said second cutting blade such that said first cutting blade leads said second cutting blade.

8. The method of cutting a profile on an edge of an item of claim 7, further comprising the step of:

(f) providing adjustment of said first cutting blade within a first blade slot and adjustment of second cutting blade within a second blade slot.

9. The method of cutting a profile on an edge of an item of claim 8, further comprising the step of:

(g) adjusting said first cutting blade such that thereof extends beyond said second cutting blade.

10. The method of cutting a profile on an edge of an item of claim 8, further comprising the step of:

(g) adjusting said second cutting blade such that thereof extends beyond said first cutting blade.

11. The method of cutting a profile on an edge of an item of claim 7, wherein:

a handle portion extending upward from said base portion.

12. The method of cutting a profile on an edge of an item of claim 7 wherein:

a first clamp retaining said first cutting blade and a second clamp retaining said second cutting blade.

13. A method of cutting a profile on an edge of an item comprising the steps of:

(a) providing a base;

(b) attaching a first cutting blade to said base to make a horizontal cut;

(c) attaching a second cutting blade to said base to make a substantially vertical cut;

(d) positioning said base against an item such that said cutting blades will cut a profiled edge in an item;

(e) pulling said base along an edge of the item to cut the profiled edge in one pass; and (f) offsetting said first cutting blade from said second cutting blade such that said second cutting blade leads said first cutting blade.

14. The method of cutting a profile on an edge of an item of claim 13, further comprising the step of:

(f) providing adjustment of said first cutting blade within a first blade slot and adjustment of second cutting blade within a second blade slot.

15. The method of cutting a profile on an edge of an item of claim 14, further comprising the step of:

(g) adjusting said first cutting blade such that thereof extends beyond said second cutting blade.

16. The method of cutting a profile on an edge of an item of claim 14, further comprising the step of:

(g) adjusting said second cutting blade such that thereof extends beyond said first cutting blade.

17. The method of cutting a profile on an edge of an item of claim 13 wherein:

a handle portion extending upward from said base portion.

18. The method of cutting a profile on an edge of an item of claim 13 wherein:

a first clamp retaining said first cutting blade and a second clamp retaining said second cutting blade.

* * * * *